US009194032B2

(12) United States Patent
Murakami et al.

(10) Patent No.: US 9,194,032 B2
(45) Date of Patent: Nov. 24, 2015

(54) HIGH-STRENGTH STEEL SHEET WITH EXCELLENT DEEP DRAWABILITY AT ROOM TEMPERATURE AND WARM TEMPERATURE, AND METHOD FOR WARM WORKING SAME

(75) Inventors: Toshio Murakami, Kobe (JP); Elijah Kakiuchi, Kobe (JP); Hideo Hata, Kobe (JP); Tatsuya Asai, Kakogawa (JP); Naoki Mizuta, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 276 days.

(21) Appl. No.: 14/001,819

(22) PCT Filed: Feb. 27, 2012

(86) PCT No.: PCT/JP2012/054838

§ 371 (c)(1),
(2), (4) Date: Aug. 27, 2013

(87) PCT Pub. No.: WO2012/118040

PCT Pub. Date: Sep. 7, 2012

(65) Prior Publication Data

US 2013/0330226 A1 Dec. 12, 2013

(30) Foreign Application Priority Data

Mar. 2, 2011 (JP) ..... 2011-045163

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/58*** | (2006.01) |
| ***C21D 8/04*** | (2006.01) |
| ***C21D 9/48*** | (2006.01) |
| ***C22C 38/00*** | (2006.01) |
| ***C22C 38/42*** | (2006.01) |
| ***C22C 38/44*** | (2006.01) |
| ***C22C 38/54*** | (2006.01) |
| ***C21D 6/00*** | (2006.01) |

(52) U.S. Cl.

CPC ..... *C22C 38/58* (2013.01); *C21D 6/005* (2013.01); *C21D 8/04* (2013.01); *C21D 8/0426* (2013.01); *C21D 9/48* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/54* (2013.01); *C21D 2211/001* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 7,468,109 | B2 * | 12/2008 | Kashima | 148/320 |
| 7,591,977 | B2 | 9/2009 | Ikeda et al. | |
| 7,767,036 | B2 | 8/2010 | Kashima et al. | |
| 7,887,648 | B2 | 2/2011 | Kinugasa et al. | |
| 8,197,617 | B2 | 6/2012 | Nakaya et al. | |
| 8,343,288 | B2 | 1/2013 | Murakami et al. | |
| 8,932,414 | B2 * | 1/2015 | Hata et al. | 148/320 |
| 2004/0055667 | A1 | 3/2004 | Takada et al. | |
| 2005/0150580 | A1 | 7/2005 | Akamizu et al. | |
| 2008/0023112 | A1 | 1/2008 | Kashima | |
| 2008/0251160 | A1 | 10/2008 | Akamizu et al. | |
| 2009/0053096 | A1 | 2/2009 | Miura et al. | |
| 2009/0242085 | A1 | 10/2009 | Ikeda et al. | |
| 2009/0277547 | A1 | 11/2009 | Saito et al. | |
| 2010/0080728 | A1 | 4/2010 | Ikeda et al. | |
| 2010/0092332 | A1 | 4/2010 | Ikeda et al. | |
| 2010/0221138 | A1 | 9/2010 | Nakaya et al. | |
| 2010/0252147 | A1 | 10/2010 | Murakami et al. | |
| 2012/0009434 | A1 | 1/2012 | Hata et al. | |
| 2012/0012231 | A1 | 1/2012 | Murakami et al. | |
| 2013/0022490 | A1 | 1/2013 | Hata et al. | |

FOREIGN PATENT DOCUMENTS

| | | | |
|---|---|---|---|
| CN | 1483090 | A | 3/2004 |
| CN | 101082100 | A | 12/2007 |

(Continued)

OTHER PUBLICATIONS

Sugimoto, K. et al., "Warm Formability of Utra High-Strength Low Alloy TRIP-aided Sheet Steels with Bainitic Ferrite Matrix ", Iron and Steel, vol. 91, No. 2, pp. 34-40, (Feb. 1, 2005).

International Search Report Issued May 22, 2012 in PCT/JP2012/054838 Filed Feb. 27, 2012.

Written Opinion of the International Searching Authority Issued May 22, 2012 in PCT/JP12/054838 Filed Feb. 27, 2012.

U.S. Appl. No. 13/988,210, filed Jun. 17, 2013, Kakiuchi, et al.

U.S. Appl. No. 13/988,382, filed May 20, 2013, Kakiuchi, et al.

*Primary Examiner* — Deborah Yee

(74) *Attorney, Agent, or Firm* — Oblon, McClelland, Maier & Neustadt, L.L.P.

(57) ABSTRACT

This high-strength steel sheet has a component composition containing, in mass %, 0.02 to 0.3% C, 1 to 3% Si, 1.8 to 3% Mn, 0.1% or less P, 0.01% or less S, 0.001 to 0.1% Al, and 0.002 to 0.03% N, the remainder being iron and impurities. The high-strength steel sheet has a structure containing, in terms of area ratio relative to the entire structure, each of the following phases: 50 to 85% bainitic ferrite; 3% or more retained austenite (γ); 10 to 45% martensite and the aforementioned retained austenite (γ); and 5 to 40% ferrite. The ratio between the Mn concentration ($Mn_{\gamma R}$) in the retained austenite (γ) and the average Mn concentration ($Mn_{av}$) in the entire structure is 1.2 or more ($Mn_{\gamma R}$/ $Mn_{av}$) based on the Mn concentration distribution obtained by means of EPMA line analysis. As a consequence, the high-strength steel sheet exhibits strength of 980 MPa or more and exerts excellent deep drawability.

7 Claims, No Drawings

(56) References Cited

FOREIGN PATENT DOCUMENTS

| | | |
|---|---|---|
| JP | 2003 193193 | 7/2003 |
| JP | 2004 190050 | 7/2004 |
| JP | 2004 244665 | 9/2004 |
| JP | 2005 220440 | 8/2005 |
| JP | 4068950 B2 | 3/2008 |
| JP | 2011 202269 | 10/2011 |
| JP | 2011 219859 | 11/2011 |
| WO | 2006 106668 | 10/2006 |
| WO | 2007 142197 | 12/2007 |

* cited by examiner

HIGH-STRENGTH STEEL SHEET WITH EXCELLENT DEEP DRAWABILITY AT ROOM TEMPERATURE AND WARM TEMPERATURE, AND METHOD FOR WARM WORKING SAME

TECHNICAL FIELD

The present invention relates to a high-strength steel sheet with excellent deep drawability at room temperature and warm temperature, and a method for warm working the same. Also, as the high-strength steel sheet of the present invention, cold rolled steel sheets, hot-dip galvanizing-coated steel sheets, and hot-dip galvannealing-coated steel sheets are included.

BACKGROUND ART

With respect to thin steel sheets used for a frame component of an automobile, high strengthening is required in order to achieve safety against collision and improvement of fuel economy. Therefore, it is required to secure press formability while increasing the strength of the steel sheet to 980 MPa class or more. In order to achieve both of high strengthening and securing of formability in high-strength steel sheets of 980 MPa class or more, use of steel utilizing the TRIP effect is known to be effective (refer to Patent Literature 1 for example).

In the Patent Literature 1, a high-strength steel sheet is disclosed which has a main phase of bainite or bainitic ferrite and contains retained austenite ($\gamma_R$) by 3% or more in terms of area ratio. However, with respect to this high-strength steel sheet, the total elongation does not reach 20% at 980 MPa or more of the tensile strength at room temperature, and further improvement of the mechanical property (hereinafter also referred to simply as "property") is required.

On the other hand, because there is a limit in formability even with a TRIP steel sheet in cold forming, a technology is proposed in which the TRIP effect is further effectively exerted and the elongation is increased by working at 100-400° C. in order to further improve the elongation (refer to Non-patent Literature 1 and Patent Literature 2).

As shown in Table 2 of the Patent Literature 2, by making $\gamma_R$ with 1 mass % or more carbon content present in the structure mainly composed of bainitic ferrite, the elongation (total elongation) in the vicinity of 200° C. can be improved to 23% in 1,200 MPa class. However, when press forming is taken into consideration, if local deformation region is utilized particularly in forming in which bulging and deep drawing are main, the strain is localized to cause breakage, and therefore uniform deformation region is often utilized. Accordingly, improvement of only the total elongation including the local elongation is insufficient, and improvement of the uniform elongation is required.

With respect to the uniform elongation, in Patent Literature 3, it is disclosed that the uniform elongation improves by adding Y and REM, however the technology can be applied only for a steel sheet with the tensile strength (TS) of up to 875 MPa as shown in its Table 3. Also, in Patent Literature 4, it is disclosed that the balance of the strength and the uniform elongation improves by a mixed structure of bainitic ferrite-polygonal ferrite-retained austenite, however the technology can also be applied only to a steel sheet with up to 859 MPa TS as shown in its Table 2.

Therefore, development of a technology that could achieve excellent uniform elongation even in a steel sheet of 980 MPa class or above was required.

CITATION LIST

Patent Literature

[Patent Literature 1] Japanese Unexamined Patent Application Publication No. 2003-193193

[Patent Literature 2] Japanese Unexamined Patent Application Publication No. 2004-190050

[Patent Literature 3] Japanese Unexamined Patent Application Publication No. 2004-244665

[Patent Literature 4] Japanese Unexamined Patent Application Publication No. 2006-274418

Non-Patent Literature

[Non-patent Literature 1] Sugimoto Koichi; So Seibu; Sakaguchi Junya; Nagasaka Akihiko; Kashima Takahiro. "Formability at warm temperature of ultra high-strength low alloy TRIP type bainitic ferrite steel sheet". Tetsu-to-Hagane. 2005, Vol. 91, No. 2, p. 34-40.

SUMMARY OF INVENTION

Technical Problems

The present invention has been developed in view of the circumstances described above, and its object is to provide a high-strength steel sheet having both of the strength at room temperature and deep drawability at room temperature and warm temperature by further improving the uniform elongation at room temperature and warm temperature while securing the strength at room temperature of 980 MPa class or above and a method for warm working the same.

Solution to Problems

The invention according to claim 1 is a high-strength steel sheet with excellent deep drawability at room temperature and warm temperature having a component composition containing:

C: 0.02-0.3% (% means mass %, same hereinafter for chemical compositions);

Si: 1.0-3.0%;

Mn: 1.8-3.0%;

P: 0.1% or less (including 0%);

S: 0.01% or less (including 0%);

Al: 0.001-0.1%; and

N: 0.002-0.03%; the remainder being iron and impurities, in which microstructure contains, in terms of area ratio relative to the entire structure (same hereinafter for the structure), each of the following phases:

bainitic ferrite: 50-85%;

retained austenite: 3% or more;

martensite+the retained austenite: 10-45%; and ferrite: 5-40%,

C content ($C_{\gamma R}$) in the retained austenite is 0.6-1.2 mass %, and a ratio $Mn_{\gamma R}/Mn_{av}$ of Mn content $Mn_{\gamma R}$ in the retained austenite and average Mn content $Mn_{av}$ in the entire structure is 1.2 or more based on the Mn content distribution obtained by means of EPMA line analysis.

The invention according to claim 2 is the high-strength steel sheet with excellent deep drawability at room temperature and warm temperature according to claim 1, the component composition thereof further containing one element or two or more elements of:

Cr: 0.01-3.0%;

Mo: 0.01-1.0%;

Cu: 0.01-2.0%;

Ni: 0.01-2.0%; and

B: 0.00001-0.01%.

The invention according to claim 3 is the high-strength steel sheet with excellent deep drawability at room temperature and warm temperature according to claim 1 or 2, the component composition thereof further containing one element or two or more elements of:

Ca: 0.0005-0.01%;

Mg: 0.0005-0.01%; and

REM: 0.0001-0.01%.

The invention according to claim 4 is a method for warm working a high-strength steel sheet including the steps of:

heating the high-strength steel sheet according to any one of claims 1-3 to 200-400° C.; and working the high-strength steel sheet thereafter within 3,600 s.

Advantageous Effects of Invention

According to the present invention, because the high-strength steel sheet has the microstructure including, in terms of area ratio relative to the entire structure, bainitic ferrite: 50-85%, retained austenite: 3% or more, martensite+the retained austenite: 10-45%, and ferrite: 5-40%, C content ($C_{\gamma R}$) in the retained austenite is 0.6-1.2 mass %, and a ratio $Mn_{\gamma R}/Mn_{av}$ of the Mn content $Mn_{\gamma R}$ in the retained austenite and the average Mn content $Mn_{av}$ in the entire structure based on the Mn content distribution obtained by means of EPMA line analysis is made 1.2 or more, the uniform elongation at room temperature and warm temperature further improves while securing the strength at room temperature of 980 MPa class or more, and a high-strength steel sheet having both of the strength at room temperature and deep drawability at room temperature and warm temperature and a method for warm working the same can be provided.

DESCRIPTION OF EMBODIMENTS

As described above, the present inventors focused their attention on a TRIP steel sheet including bainitic ferrite and retained austenite ($\gamma_R$) having an infrastructure (matrix) with high dislocation density similar to those in the prior arts, and have studied further in order to further improve deep drawability by improving the uniform elongation while securing the strength at room temperature.

The present inventors considered that utilization of ferrite with low dislocation density and high work hardening ratio was effective for improvement of the uniform elongation, and decided to introduce ferrite into the microstructure of the steel sheet by a proper amount.

Also, the present inventors considered that it was effective to increase the Mn content of $\gamma_R$ in order to prepare $\gamma_R$ that strongly contributed to improvement of the uniform elongation by much amount.

However, when the Mn amount added to steel is simply increased in order to increase the Mn content in $\gamma_R$, the ductility of ferrite drops due to solid solution strengthening action of Mn, the elongation deteriorates adversely, the strength of the hot rolled sheet increases, and cold rolling becomes difficult. Therefore, it is necessary to increase the Mn content in $\gamma_R$ without increasing the Mn amount added to steel.

Here, it is known that, when ferrite+austenite ($\alpha+\gamma$) two phase region heating is executed, Mn is concentrated to austenite ($\gamma$) side which affects the amount of transformation from ferrite ($\alpha$) to austenite ($\gamma$). That is, when the two phase region heating temperature is low, the ferrite fraction increases and the Mn content in $\gamma_R$ also increases. Therefore, although stable $\gamma_R$ can be secured, the strength cannot be secured. On the other hand, when the two phase region heating temperature is high, the ferrite fraction drops and the Mn content in $\gamma_R$ also drops. Therefore, although the strength can be secured, stable $\gamma_R$ cannot be secured.

According to prior arts, because the ferrite fraction and the Mn content in $\gamma_R$ were not balanced, it was hard to secure stable $\gamma_R$ while securing the strength.

Therefore, in the present invention, it was projected to achieve both of improvement of the ductility of the matrix (parent phase) and improvement of the uniform elongation by optimizing the TRIP effect by $\gamma_R$ by introducing ferrite of a proper amount and increasing the Mn content in $\gamma_R$ while limiting the added Mn amount, and to achieve improvement of the strength by further introducing martensite partially.

More specifically, it was found out that both of the strength at room temperature and the deep drawability could be achieved by reducing the strength of the matrix (parent phase) by introducing ferrite of 5-40% in terms of the area ratio, making the area ratio of retained austenite ($\gamma_R$) 3% or more and the C content ($C_{\gamma R}$) in the $\gamma_R$ 0.6-1.2 mass %, thereby promoting the TRIP phenomenon (strain induced transformation) to promote work hardening and to increase the strength, and achieving both of improvement of the ductility of the matrix (parent phase) and improvement of the uniform elongation by optimizing the TRIP effect by $\gamma_R$ by increasing the Mn content in $\gamma_R$ to secure stable $\gamma_R$ by making the ratio $Mn_{\gamma R}/Mn_{av}$ of the Mn content $Mn_{\gamma R}$ in the $\gamma_R$ and the average Mn content $Mn_{av}$ in the entire structure 1.2 or more based on the Mn content distribution obtained by means of EPMA line analysis in order to achieve both of increasing the strength and increasing the ductility.

Also, further studies were made based on the above knowledge, and the present invention was completed.

First, the microstructure characterizing the steel sheet of the present invention will be described below.

[Microstructure of Steel Sheet of the Present Invention]

As described above, the steel sheet of the present invention is on the basis of the microstructure of the TRIP steel similarly to the prior arts, however it is different from the prior arts in terms that ferrite is contained particularly by a predetermined amount, $\gamma_R$ with predetermined carbon content is contained by a predetermined amount, and the Mn content distribution is controlled.

<Bainitic Ferrite: 50-85%>

"Bainitic ferrite" in the present invention has an infrastructure in which the bainite structure has a lath-shaped structure with high dislocation density, is apparently different from the bainite structure in terms that it does not include carbide in the microstructure, and is also different from a polygonal ferrite structure having an infrastructure without the dislocation density or with extremely low dislocation density or from a quasi-polygonal ferrite structure having an infrastructure such as fine sub-grains and the like (refer to "Hagane-no beinaito shashinshuu-1" (Photos of bainite of steel-1) issued by the Basic Research Group of The Iron and Steel Institute of Japan). Under observation by an optical microscope and a SEM, this microstructure exhibits an acicular shape and is hard in discrimination, and therefore identification of the infrastructure by TEM observation is required in order to determine the clear difference from the bainite structure, the polygonal ferrite structure and the like.

As described above, the microstructure of the steel sheet of the present invention is uniform, fine and highly ductile, and can be improved in the balance of the strength and formability by making bainitic ferrite with high dislocation density and high strength the parent phase.

In the steel sheet of the present invention, the amount of the bainitic ferrite structure is required to be 50-85% (preferably 60-85%, and more preferably 70-85%) in terms of the area ratio relative to the entire structure. The reason is that the effect by the bainitic ferrite structure is thereby exerted effectively. Also, the amount of the bainitic ferrite structure is to be determined by the balance with $\gamma_R$, and is recommendable to be properly controlled so as to exert the desired properties.

<To Contain Retained Austenite ($\gamma_R$) by 3% or More in Terms of Area Ratio Relative to Entire Structure>

$\gamma_R$ is effective for improving the total elongation, and is required to be present by 3% or more (preferably 5% or more, and more preferably 10% or more) in terms of the area ratio relative to the entire structure in order to exert such action effectively.

<Martensite+the Retained Austenite ($\gamma_R$): 10-45%>

Although martensite is partly introduced into the microstructure in order to secure the strength, formability cannot be secured when the amount of martensite increases excessively, and therefore the total area ratio of martensite+$\gamma_R$ relative to the entire structure was limited to 10% or more (preferably 12% or more, and more preferably 16% or more) and 45% or less.

<Ferrite: 5-40%>

Ferrite mentioned here means polygonal ferrite. Because ferrite is a soft phase, it does not contribute to increase the strength, however, because ferrite is effective in increasing the ductility, in order to improve the balance of the strength and elongation, ferrite is introduced in the range of 5% or more (preferably 10% or more, and more preferably 15% or more) and 40% or less (preferably 35% or less, and more preferably 30% or less) in terms of the area ratio with which the strength can be assured.

<C Content ($C_{\gamma R}$) in Retained Austenite ($\gamma_R$): 0.6-1.2 mass %>

$C_{\gamma R}$ is an indicator affecting the stability when $\gamma_R$ transforms to martensite in working. When $C_{\gamma R}$ is excessively low, because $\gamma_R$ is instable, working induced martensite transformation occurs after application of the stress and before plastic deformation, and therefore stretch formability cannot be secured. On the other hand, when $C_{\gamma R}$ is excessively high, $\gamma_R$ becomes excessively stable, working induced martensite transformation does not occur even when working is applied, and therefore stretch formability cannot be secured also in this case. In order to secure sufficient stretch formability, $C_{\gamma R}$ is required to be 0.6-1.2 mass %, preferably 0.7-0.9 mass %.

<Ratio $Mn_{\gamma R}/Mn_{av}$ of Mn Content $Mn_{\gamma R}$ in the $\gamma_R$ and Average Mn Content $Mn_{av}$ in the Entire Structure Based on Mn Content Distribution Obtained by Means of EPMA Line Analysis: 1.2 or More>

By distributing Mn added to steel between ferrite and austenite by two phase region heating, the Mn content in $\gamma_R$ can be increased and $\gamma_R$ can be obtained at room temperature while high ductility is imparted to the matrix. When the Mn content in $\gamma_R$ is excessively low, the stability of $\gamma_R$ is low and the $\gamma_R$ amount cannot be secured at room temperature. Also, when the Mn content in ferrite is excessively high, the deformability of the matrix drops and the elongation deteriorates. Therefore, the present inventors introduced $Mn_{\gamma R}/Mn_{av}$ as an indicator for evaluating the segregation degree of Mn into $\gamma_R$, and the value of the indicator was made 1.2 or more.

<Others: Bainite (Including 0%)>

Although the steel sheet of the present invention may be formed of only the structure described above (mixed structure of bainitic ferrite, martensite, ferrite and $\gamma_R$), bainite may be included as another different kind structure within a range not to be harmful to the actions of the present invention. Although this microstructure can inevitably remain through the manufacturing process of the steel sheet of the present invention, it is preferable to be as little as possible, and is recommendable to be controlled to 5% or less, more preferably 3% or less in terms of the area ratio relative to the entire structure.

[Respective Measurement Methods of Area Ratio of Each Phase, C Content ($C_{\gamma R}$) in $\gamma_R$, Average Mn Content in the Entire Structure, and Mn Content in $\gamma_R$]

Here, respective measurement methods of the area ratio of each phase, the C content ($C_{\gamma R}$) in $\gamma_R$, the average Mn content in the entire structure, and the Mn content in $\gamma_R$ will be described.

With respect to the area ratio of each phase of the microstructure in the steel sheet, the steel sheet was Le Pera etched, a white region for example was defined as "martensite+retained austenite ($\gamma_R$)" to identify the microstructure in the observation under a transmission electron microscope (TEM; 1,500 magnifications), and the area ratio of each phase was thereafter measured in the observation under an optical microscope (1,000 magnifications).

Also, with respect to the area ratio of $\gamma_R$ and the C content ($C_{\gamma R}$) in $\gamma_R$, respective specimen steel sheets were ground to ¼ thickness, were thereafter subjected to chemical polishing, and were measured by X-ray diffraction method (ISIJ Int. Vol. 33, (1933), No. 7, p. 776). Also, with respect to the area ratio of ferrite, respective specimen steel sheets were subjected to nital etching, the black region was identified as ferrite in the observation under a scanning electron microscope (SEM; 2,000 magnifications), and the area ratio was obtained.

With respect to the average Mn content in the entire structure and the Mn content in $\gamma_R$, the range of 200 μm or more was subjected to EPMA line analysis at 0.2 μm steps, the average value of the Mn content of all measuring points was defined as the average Mn content of the entire structure, and the average value of the Mn content of 5% portion from the high Mn content side out of the Mn content of all measuring points was defined as the Mn content in $\gamma_R$.

Next, the component composition constituting the steel sheet of the present invention will be described. Below, all units of the chemical composition are mass %.

[Component Composition of Steel Sheet of the Present Invention]

C: 0.02-0.3%

C is an element indispensable for obtaining the desired main structures (bainitic ferrite+martensite+$\gamma_R$) while securing the high strength. In order to exert such actions effectively, C is required to be added by 0.02% or more (preferably 0.05% or more, and more preferably 0.10% or more). However, when C exceeds 0.3%, it is not suitable for welding.

Si: 1.0-3.0%

Si is an element effectively suppressing disintegration of $\gamma_R$ and formation of carbide. Si is particularly useful also as a solid solution strengthening element. In order to exert such actions effectively, Si is required to be added by 1.0% or more, preferably 1.1% or more, and more preferably 1.2% or more. However, when Si is added exceeding 3.0%, formation of bainitic ferrite+martensite structure is obstructed, hot deformation resistance increases, the weld bead is liable to be embrittled, the surface properties of the steel sheet is also adversely affected, and therefore the upper limit thereof is to be made 3.0%. It is preferable to be 2.5% or less, more preferably 2.0% or less.

Mn: 1.8-3.0%

Mn effectively acts as a solid solution strengthening element, and also exerts an action of promoting transformation to promote formation of bainitic ferrite+martensite structure. Also, Mn is an element required for stabilizing y to obtain the required $\gamma_R$. Further, Mn contributes also to improvement of the quenchability. In order to exert such actions effectively, Mn is required to be added by 1.8% or more, preferably 1.9% or more, and more preferably 2.0% or more. However, when Mn is added exceeding 3.0%, adverse effects such as occurrence of slab cracking and the like are seen. Mn is preferable to be 2.8% or less, more preferably 2.5% or less.

P: 0.1% or less (including 0%)

P is an element which is present inevitably as an impurity element but may be added in order to secure desired $\gamma_R$. However, when P is added exceeding 0.1%, secondary work performance deteriorates. Therefore P is more preferable to be 0.03% or less.

S: 0.01% or less (including 0%)

S also is an element which is present inevitably as an impurity element, forms sulfide-based inclusions such as MnS and the like, and becomes the start point of a crack to deteriorate the workability. S is preferable to be 0.01% or less, more preferably 0.005% or less.

Al: 0.001-0.1%

Al is an element added as a deoxidizing agent and effectively suppressing disintegration of $\gamma_R$ and formation of carbide jointly with Si described above. In order to exert such actions effectively, Al is required to be added by 0.001% or more. However, even when Al is added excessively, the effects saturate which is an economical loss, and therefore the upper limit thereof is to be 0.1%.

N: 0.002-0.03%

Although N is an element that is present inevitably, it forms precipitates by joining with a carbonitride of Al, Nb and the like, and contributes to improvement of the strength and to miniaturization of the miocrostructure. When the N content is excessively low, the austenitic grains are coarsened, elongated lath-shaped structures become main as a result, and therefore the aspect ratio of $\gamma_R$ becomes large. On the other hand, when the N content is excessively high, casting becomes hard in the low-carbon steel such as the material of the present invention, and therefore manufacturing itself becomes impossible.

The steel of the present invention basically contains the compositions described above with the remainder substantially being iron and inevitable impurities, however, in addition to them, following permissible compositions may be added within the range not to be harmful to the actions of the present invention.

One element or two or more elements of:

Cr: 0.01-3.0%

Mo: 0.01-1.0%,

Cu: 0.01-2.0%,

Ni: 0.01-2.0%, and

B: 0.00001-0.01%

These elements are elements useful as the strengthening elements of steel and effective in stabilizing and securing the required amount of $\gamma_R$. In order to exert such actions effectively, it is recommendable to respectively add Mo: 0.01% or more (more preferably 0.02% or more), Cu: 0.01% or more (more preferably 0.1% or more), Ni: 0.01% or more (more preferably 0.1% or more), and B: 0.00001% or more (more preferably 0.0002% or more).

However, even when Cr is added to exceed 3.0%, Mo is added to exceed 1.0%, Cu and Ni are added to exceed 2.0% respectively, and B is added to exceed 0.01%, the effects described above saturate which is an economical loss. Cr: 2.0% or less, Mo: 0.8% or less, Cu: 1.0% or less, Ni: 1.0% or less, and B: 0.0030% or less are more preferable.

One element or two or more elements of:

Ca: 0.0005-0.01%,

Mg: 0.0005-0.01%, and

REM: 0.0001-0.01%

These elements are elements effective in controlling the form of sulfide in steel and improving the workability. Here, as REM (rare earth element) used in the present invention, Sc, Y, lanthanoid and the like can be cited. In order to exert such actions effectively, it is recommendable to add Ca and Mg by 0.0005% or more (more preferably 0.0001% or more) respectively, and REM by 0.0001% or more (more preferably 0.0002% or more). However, even when Ca and Mg are added to exceed 0.01% respectively and REM is added to exceed 0.01%, the effects described above saturate which is an economical loss. It is more preferable that Ca and Mg are 0.003% or less, and REM is 0.006% or less.

[Warm Working Method]

It is particularly recommendable that the steel sheet of the present invention is heated to a proper temperature between 100-400° C. and is thereafter worked within 3,600 s (more preferably within 1,200 s).

By executing working before disintegration of $\gamma_R$ occurs under the temperature condition optimizing the stability of $\gamma_R$, the elongation and deep drawability can be maximized.

With respect to the component worked by this warm working method, the strength after cooling is made uniform within the cross section thereof, and the portion of low strength becomes less compared with a component whose strength distribution within a same cross section is large, and therefore the strength of the component can be increased.

That is, in the steel sheet including $\gamma_R$, the yield ratio is low and the work hardening ratio is high in the low strain range in general. Therefore, the strain amount dependability of the strength, particularly the yield stress, after applying the strain in the region where the applied strain amount is small becomes extremely large. When a component is formed by press working, the strain amount applied changes according to the portion, and there is also a region partly where the strain is scarcely applied. Therefore, there may be a case in which large difference in strength occurs between the region subjected to working and the region not subjected to working within a component, and the strength distribution is formed within the component. When such strength distribution exists, deformation and buckling occur because a region with low strength yields, and therefore, a portion where the strength is lowest comes to determine the strength of the component.

The reason the yield stress is low in steel including $\gamma_R$ is considered to be that martensite formed simultaneously in introducing $\gamma_R$ introduces movable dislocation into the surrounding parent phase at the time of transformation. Therefore, when this dislocation movement is prevented even in a region where the working amount is less, the yield stress can be improved and the strength of the component can be increased. In order to suppress movement of the movable dislocation, it is effective to heat the raw material to eliminate the movable dislocation, and to stop the movement by strain aging of solid-dissolved carbon and the like, and the yield stress can be increased by doing so.

Accordingly, when a steel sheet including $\gamma_R$ is heated to a proper temperature between 100-400° C. and is press-formed (warm working), the yield stress increases even in a portion with low strain, the stress distribution within the component becomes small, and thereby the strength of the component can be increased.

Next, a preferable manufacturing method for obtaining the steel sheet of the present invention described above will be described below.

[Preferable Manufacturing Method for Steel Sheet of the Present Invention]

The steel sheet of the present invention is manufactured by subjecting the steel satisfying the component composition described above to hot rolling, cold rolling then, and heat treatment thereafter.

[Hot Rolling Condition]

Although the hot rolling condition is not particularly limited, the finishing temperature of hot rolling (rolling finish temperature; FDT) may be 800-900° C., and the winding temperature may be 300-600° C. for example.

[Cold Rolling Condition]

Also, with respect to cold rolling, the heat treatment is executed under the heat treatment condition described below while the cold rolling ratio is made 20-70%.

[Heat Treatment Condition]

With respect to the heat treatment condition, the steel sheet is subjected to soaking at the temperature level of two steps in the ferrite+austenite (α+γ) two phase region to properly distribute Mn to ferrite (α) and austenite (γ), a constant amount of Mn is converted to austenite, the steel sheet is cooled rapidly at a predetermined cooling rate for supercooling, is retained thereafter for a predetermined time at the supercooling temperature for austemper treatment, and thereby the desired microstructure can be obtained. Also, plating and alloying treatment may be executed within the range not to be harmful to the actions of the present invention without extremely disintegrating the desired microstructure.

More specifically, the cold rolled material after the cold rolling is retained at the temperature range of (0.9Ac1+0.1Ac3)-(0.7Ac1+0.3Ac3) (the first soaking temperature) for the time of 60-1,800 s (the first soaking time), is thereafter retained further at the temperature range of (0.4Ac1+0.6Ac3)-(0.1Ac1+0.9Ac3) (the second soaking temperature) for the time of 100 s or less (the second soaking time), is thereafter rapid-cooled to the temperature range of 350-500° C. at the average cooling rate of 15° C./s or more for supercooling, is retained at the rapid cooling stopping temperature (supercooling temperature) for the time of 100-1,800 s for austemper treatment, and is thereafter cooled to the room temperature.

<Retaining at Temperature Range of (0.9Ac1+0.1Ac3)-(0.7Ac1+0.3Ac3) (First Soaking Temperature) for Time of 60-1,800 s (First Soaking Time)>

This condition is for promoting distribution of Mn (segregation to the γ side) by retaining at the temperature on the low temperature side of the two phase region for a long time, and for achieving high $Mn_{\gamma R}/Mn_{av}$ ratio.

<Retaining Further at Temperature Range of (0.4Ac1+0.6Ac3)-(0.1Ac1+0.9Ac3) (Second Soaking Temperature) for Time of 100 s or Less (Second Soaking Time)>

By retaining thereafter at the temperature range on the high temperature side of the two phase region for a short time, conversion to austenite is proceeded for optimizing the fraction of ferrite and austenite before distribution of Mn (segregation to the γ side) distributed in the temperature range of the low temperature side of the two phase region is eliminated, and thereby high $Mn_{\gamma R}/Mn_{av}$ ratio and the fraction of bainitic ferrite formed in reverse transformation from austenite in cooling can be secured.

<Rapid-Cooling to Temperature Range of 350-500° C. at Average Cooling Rate of 15° C./s or More for Supercooling and Retaining at the Rapid Cooling Stopping Temperature (Supercooling Temperature) for time of 100-1,800 s>

This condition is for obtaining the desired microstructure by executing austemper treatment.

EXAMPLE

In order to confirm the effect of the present invention, the influence of the mechanical property of the high-strength steel sheet at room temperature and warm temperature when the component composition and heat treatment condition were changed was investigated. The specimen steel with each component composition shown in Table 1 below was molten under vacuum and was made a slab of 30 mm sheet thickness, the slab was thereafter heated to 1,200° C., is hot rolled to the sheet thickness of 2.4 mm with the rolling finishing temperature (FDT) of 900° C. and the winding temperature of 650° C., was thereafter cold rolled at the cold rolling ratio of 50% into a cold rolled material with the sheet thickness of 1.2 mm, and was subjected to the heat treatment shown in Table 2 below. More specifically, the cold rolled material was heated to the first soaking temperature T1° C., was maintained at the temperature for the first soaking time of t1 s, was thereafter heated further to the second soaking temperature T2° C., was maintained at the temperature for the second soaking time of t2 s, was cooled thereafter to the cooling stopping temperature (supercooling temperature) T3 at the cooling rate of CR1° C./s, was maintained at the temperature for t3 s, was thereafter either air-cooled or maintained at the cooling stopping temperature (supercooling temperature) T3° C. for t3 s, was thereafter further maintained at the retention temperature T4° C. for t4 s, and was thereafter air-cooled.

With respect to the steel sheets thus obtained, the area ratio of each phase, C content ($C_{\gamma R}$) in $\gamma_R$, average Mn content in the entire structure, and Mn content in $\gamma_R$ were measured by the measuring method described in the article of the [Description of Embodiments].

Also, with respect to the steel sheets described above, in order to evaluate the mechanical properties at room temperature and warm temperature, the tensile strength (TS), uniform elongation (uEL), and total elongation (EL) were measured respectively at room temperature and warm temperature according to the procedure described below.

TS was measured by the tensile test using JIS No. 5 specimen. Also, the tensile test was executed with the strain rate of 1 mm/s.

These results are shown in Table 3.

TABLE 1

| Steel kind | Composition (mass %) | | | | | | | | Transformation temperature (° C.) | |
|---|---|---|---|---|---|---|---|---|---|---|
| symbol | C | Si | Mn | P | S | Al | N | Others | Ac1 | Ac3 |
| A | 0.18 | 1.50 | 2.00 | 0.010 | 0.001 | 0.030 | 0.0040 | — | 745 | 850 |
| B | 0.18 | 1.50 | 2.00 | 0.010 | 0.001 | 0.030 | 0.0040 | Ca: 0.010 | 745 | 850 |
| C | 0.18 | 1.50 | 2.00 | 0.010 | 0.001 | 0.030 | 0.0040 | Mg: 0.010 | 745 | 850 |
| Da | 0.01a | 1.50 | 2.00 | 0.010 | 0.001 | 0.030 | 0.0040 | Ca: 0.010 | 745 | 916 |
| Fa | 0.18 | 0.25a | 2.00 | 0.010 | 0.001 | 0.030 | 0.0040 | Ca: 0.010 | 709 | 794 |
| Ia | 0.18 | 4.00a | 2.00 | 0.010 | 0.001 | 0.030 | 0.0040 | Ca: 0.010 | 818 | 962 |
| Ja | 0.18 | 1.50 | 0.80a | 0.010 | 0.001 | 0.030 | 0.0040 | Ca: 0.010 | 758 | 886 |
| Ma | 0.18 | 1.50 | 4.00a | 0.010 | 0.001 | 0.030 | 0.0040 | Ca: 0.010 | 724 | 790 |
| N | 0.18 | 1.50 | 2.00 | 0.010 | 0.001 | 0.030 | 0.0040 | Cr: 0.15, Ca: 0.010 | 745 | 848 |
| O | 0.18 | 1.50 | 2.00 | 0.010 | 0.001 | 0.030 | 0.0040 | Mo: 0, 20, Ca: 0.010 | 749 | 856 |
| P | 0.18 | 1.50 | 2.00 | 0.010 | 0.001 | 0.030 | 0.0040 | Cu: 0.50, Ca: 0.010 | 745 | 840 |
| Q | 0.18 | 1.50 | 2.00 | 0.010 | 0.001 | 0.030 | 0.0040 | Ni: 0.40, Ca: 0.010 | 745 | 844 |
| R | 0.18 | 1.50 | 2.00 | 0.010 | 0.001 | 0.030 | 0.0040 | B: 0.0010, Ca: 0.010 | 745 | 855 |
| S | 0.18 | 2.50 | 2.80 | 0.010 | 0.001 | 0.030 | 0.0040 | Ca: 0.010, Ti: 0.013 | 766 | 871 |
| U | 0.22 | 1.50 | 2.00 | 0.010 | 0.001 | 0.030 | 0.0040 | Ca: 0.010 | 736 | 841 |
| V | 0.12 | 2.00 | 2.50 | 0.010 | 0.001 | 0.030 | 0.0040 | Ca: 0.010 | 754 | 873 |

(Affix a: out of the range of the present invention)

TABLE 2

| Heat treatment No. | Steel kind symbol | 0.9Ac1 + 0.1Ac3 (° C.) | 0.7Ac1 + 0.3Ac3 (° C.) | 0.4Ac1 + 0.6Ac3 (° C.) | 0.1Ac1 + 0.9Ac3 (° C.) | Heating condition: First soaking temperature T1 (° C.) | First soaking time t1 (s) | Second soaking temperature T2 (° C.) | Second soaking time T2 (s) | Cooling condition Cooling rate CR1 (° C./s) | Retention condition: Supercooling temperature T3 (° C.) | Retention time t3 (s) | Retention temperature T4 (s) | Retention time t4 (s) |
|---|---|---|---|---|---|---|---|---|---|---|---|---|---|---|
| 1 | A | 756 | 777 | 808 | 839 | 760 | 600 | 820 | 20 | 40 | 400 | 60 | 520 | 20 |
| 2 | B | 756 | 777 | 808 | 839 | 760 | 600 | 820 | 20 | 40 | 400 | 60 | 520 | 20 |
| 3 | C | 756 | 777 | 808 | 839 | 760 | 600 | 820 | 20 | 40 | 400 | 60 | 520 | 20 |
| 4 | D a | 762 | 796 | 848 | 899 | 780 | 600 | 860 | 20 | 40 | 400 | 60 | 520 | 20 |
| 5 | F a | 717 | 734 | 760 | 786 | 720 | 600 | 780 | 20 | 40 | 400 | 60 | 520 | 20 |
| 6 | I a | 832 | 861 | 904 | 947 | 840 | 600 | 920 | 20 | 40 | 400 | 60 | 520 | 20 |
| 7 | J a | 771 | 796 | 835 | 873 | 780 | 600 | 860 | 20 | 40 | 400 | 60 | 520 | 20 |
| 8 | M a | 730 | 744 | 763 | 783 | 740 | 600 | 780 | 20 | 40 | 400 | 60 | 520 | 20 |
| 9 | N | 756 | 776 | 807 | 838 | 760 | 600 | 820 | 20 | 40 | 400 | 60 | 520 | 20 |
| 10 | O | 759 | 781 | 813 | 845 | 760 | 600 | 820 | 20 | 40 | 400 | 60 | 520 | 20 |
| 11 | P | 755 | 774 | 802 | 830 | 760 | 600 | 820 | 20 | 40 | 400 | 60 | 520 | 20 |
| 12 | Q | 755 | 775 | 804 | 834 | 760 | 600 | 820 | 20 | 40 | 400 | 60 | 520 | 20 |
| 13 | R | 756 | 778 | 811 | 844 | 760 | 600 | 820 | 20 | 40 | 400 | 60 | 520 | 20 |
| 14 | S | 776 | 797 | 829 | 860 | 780 | 600 | 840 | 20 | 40 | 400 | 60 | 520 | 20 |
| 15 | U | 747 | 767 | 799 | 830 | 760 | 600 | 820 | 20 | 40 | 400 | 60 | 520 | 20 |
| 16 | V | 766 | 790 | 826 | 861 | 780 | 600 | 840 | 20 | 40 | 400 | 60 | 520 | 20 |
| 17 b | B | 756 | 777 | 808 | 839 | 820 b | 600 | — b | — b | 40 | 400 | 60 | 520 | 20 |
| 18 b | B | 756 | 777 | 808 | 839 | 760 | 600 | — b | — b | 40 | 400 | 60 | 520 | 20 |
| 19 b | B | 756 | 777 | 808 | 839 | 760 | 600 | 820 | 20 | 5 b | 400 | 60 | 520 | 20 |
| 20 | B | 756 | 777 | 808 | 839 | 760 | 600 | 820 | 20 | 40 | 450 | 60 | 520 | 20 |
| 21 | B | 756 | 777 | 808 | 839 | 760 | 600 | 820 | 20 | 40 | 350 | 60 | 520 | 20 |
| 22 b | B | 756 | 777 | 808 | 839 | 760 | 600 | 820 | 20 | 40 | 200 b | 60 | 600 | 20 |
| 23 | B | 756 | 777 | 808 | 839 | 760 | 600 | 820 | 20 | 40 | 400 | 60 | — | — |
| 24 | B | 756 | 777 | 808 | 839 | 760 | 600 | 820 | 20 | 40 | 400 | 300 | — | — |
| 25 | B | 756 | 777 | 808 | 839 | 760 | 600 | 820 | 20 | 40 | 400 | 60 | 520 | 20 |

(Affix a: out of the range of the present invention, affix b: out of the recommended range)

TABLE 3

| Steel No. | Steel kind symbol | Heat treatment No. | Microstructure: Area ratio (%) BF | F | M + $\gamma_R$ | $\gamma_R$ | Others | $C\gamma_R$ (mass %) | $Mn\gamma_R$/Mnav (—) | Mechanical properties: Properties at room temperature TS (MPa) | uEL (%) | EL (%) | Properties at warm temperature: Temperature (° C.) (° C.) | TS (MPa) | uEL (%) | EL (%) | Determination |
|---|---|---|---|---|---|---|---|---|---|---|---|---|---|---|---|---|---|
| 1 | A | 1 | 60.5 | 21.3 | 18.2 | 12.1 | 0.0 | 0.87 | 1.30 | 1004 | 15.8 | 20.9 | 300 | 1056 | 22.0 | 32.1 | ○ |
| 2 | B | 2 | 58.6 | 20.9 | 20.5 | 12.5 | 0.0 | 0.86 | 1.29 | 1019 | 15.7 | 20.0 | 300 | 1056 | 22.3 | 32.6 | ○ |
| 3 | C | 3 | 58.7 | 21.6 | 19.7 | 12.3 | 0.0 | 0.89 | 1.29 | 1004 | 15.6 | 20.8 | 300 | 1060 | 22.1 | 32.3 | ○ |
| 4 | Da | 4 | 25.4a | 67.0a | 7.6a | 0.0a | 0.0 | 0.03a | 1.12a | 554a | 20.1 | 28.6 | 300 | 577 | 21.4 | 30.2 | X |
| 5 | Fa | 5 | 87.8a | 12.2 | 0.0a | 0.0a | 0.0 | 0.03a | 1.30 | 867a | 8.6 | 20.1 | 300 | 850 | 8.4 | 19.8 | X |
| 6 | Ia | 6 | 21.1a | 20.4 | 58.5a | 5.7 | 0.0 | 0.65 | 1.33 | 1354 | 5.1a | 8.3 | 300 | 1318 | 8.2a | 11.2 | X |
| 7 | Ja | 7 | 20.6a | 61.0a | 18.4 | 11.8 | 0.0 | 0.00a | 1.30 | 806a | 20.2 | 28.8 | 300 | 830 | 26.8 | 36.0 | X |
| 8 | Ma | 8 | 21.2a | 10.7 | 68.1a | 4.2 | 0.0 | 0.61 | 1.32 | 1396 | 6.6a | 9.1 | 300 | 1332 | 8.1a | 10.2 | X |
| 9 | N | 9 | 60.3 | 19.5 | 20.2 | 15.9 | 0.0 | 0.87 | 1.36 | 1051 | 15.5 | 20.3 | 300 | 1085 | 22.3 | 32.8 | ○ |
| 10 | O | 10 | 60.3 | 25.4 | 14.3 | 11.7 | 0.0 | 0.87 | 1.29 | 1053 | 15.8 | 20.4 | 300 | 1083 | 22.8 | 32.2 | ○ |
| 11 | P | 11 | 58.3 | 15.9 | 25.8 | 11.5 | 0.0 | 0.90 | 1.29 | 1058 | 15.1 | 20.5 | 300 | 1096 | 22.2 | 32.8 | ○ |
| 12 | Q | 12 | 58.6 | 17.5 | 23.9 | 12.3 | 0.0 | 0.86 | 1.31 | 1068 | 15.4 | 20.9 | 300 | 1082 | 22.3 | 32.1 | ○ |
| 13 | R | 13 | 59.3 | 22.6 | 18.1 | 11.6 | 0.0 | 0.86 | 1.34 | 1055 | 15.5 | 21.0 | 300 | 1093 | 22.2 | 32.5 | ○ |
| 14 | S | 14 | 49.7a | 21.5 | 28.8 | 18.0 | 0.0 | 0.50a | 1.33 | 1208 | 12.2 | 15.1 | 300 | 1210 | 16.6a | 19.2 | X |
| 15 | U | 15 | 59.6 | 14.5 | 25.9 | 14.8 | 0.0 | 0.88 | 1.31 | 1012 | 17.3 | 22.6 | 300 | 1057 | 24.8 | 35.6 | ○ |
| 16 | V | 16 | 58.5 | 23.0 | 18.5 | 9.9 | 0.0 | 0.88 | 1.36 | 1010 | 14.9 | 19.8 | 300 | 1051 | 20.6 | 32.5 | ○ |
| 17 | B | 17b | 59.6 | 22.0 | 18.4 | 7.1 | 0.0 | 1.10 | 1.13a | 1008 | 12.4a | 16.3 | 300 | 1018 | 15.7a | 24.1 | X |
| 18 | B | 18b | 19.1a | 55.7a | 25.2 | 4.6 | 0.0 | 0.71 | 1.54 | 769a | 21.0 | 25.1 | 300 | 815 | 24.0 | 28.4 | X |
| 19 | B | 19b | 13.6a | 60.4a | 26.0 | 14.1 | 0.0 | 1.01 | 1.37 | 821a | 24.3 | 28.7 | 300 | 878 | 21.6 | 28.9 | X |
| 20 | B | 20 | 60.3 | 21.7 | 18.0 | 9.7 | 0.0 | 0.80 | 1.34 | 1008 | 17.7 | 22.1 | 300 | 1018 | 22.7 | 35.2 | ○ |
| 21 | B | 21 | 55.2 | 20.1 | 24.7 | 11.3 | 0.0 | 0.89 | 1.29 | 1184 | 14.8 | 19.5 | 300 | 1057 | 20.2 | 32.8 | ○ |
| 22 | B | 22b | 28.2a | 21.7 | 50.1a | 2.8a | 0.0 | 1.01 | 1.33 | 1518 | 5.0a | 6.6 | 300 | 1508 | 7.0a | 9.0 | X |
| 23 | B | 23 | 58.8 | 20.5 | 20.7 | 9.5 | 0.0 | 1.11 | 1.37 | 1017 | 15.7 | 20.4 | 300 | 1061 | 20.4 | 32.6 | ○ |
| 24 | B | 24 | 59.4 | 20.8 | 19.8 | 9.7 | 0.0 | 0.88 | 1.31 | 1005 | 16.3 | 22.0 | 300 | 1050 | 26.0 | 38.3 | ○ |
| 25 | B | 25 | 60.3 | 20.4 | 19.3 | 9.3 | 0.0 | 1.05 | 1.28 | 1001 | 15.6 | 20.1 | 300 | 1061 | 20.1 | 32.2 | ○ |
| 26 | " | " | " | " | " | " | " | " | " | " | " | " | 50a | 906 | 15.5a | 18.7 | X |
| 27 | " | " | " | " | " | " | " | " | " | " | " | " | 450a | 820 | 10.2a | 15.0 | X |

(Affix a: out of the range of the present invention, affix b: out of the recommended range, BF: bainitic ferrite, F: ferrite, M: martensite, $\gamma_R$: retained austenite ○: [980 MPa ≤ TS < 1,180 MPa at room temperature and uEL ≥ 13% at room temperature and uEL ≥ 20% at warm temperature] or [TS ≥ 1,180 MPa at room temperature and uEL ≥ 12% at room temperature and uEL ≥ 17% at warm temperature] X: the case not satisfying the condition of ○ described above)

As shown in these tables, in all of the steel Nos. 1-3, 9-13, 15, 16, 20, 21, 23-25 which are the steel sheets of the present invention, the steel kind satisfying the range of the component composition of the present invention was used, and the heat treatment was executed under the recommended heat treatment condition. As a result, the requirement of the stipulation on the microstructure of the present invention was satisfied, and the high-strength steel sheets excellent in the uniform elongation (uEL) at room temperature and warm temperature while securing the strength (TS) of 980 kPa or more at room temperature were obtained.

On the other hand, in all of the steel Nos. 4-8 which are the comparative steels, because the steel kind not satisfying the requirement of the component composition stipulated in the present invention was used, although the heat treatment was executed under the recommended heat treatment condition, the requirement of the stipulation on the microstructure of the present invention was not satisfied, and at least either property of the strength at room temperature (TS) and the uniform elongation (uEL) at room temperature and warm temperature is inferior.

Also, in all of the steel Nos. 17-19, 22 which are the other comparative steels, although the steel kind satisfying the range of the component composition of the present invention was used, the heat treatment was executed under the condition deviated from the recommended heat treatment condition. As a result, the requirement on the microstructure of the present invention was not satisfied, and at least either property of the strength at room temperature (TS) and the uniform elongation (uEL) at room temperature and warm temperature is also inferior.

Further, in the steel Nos. 25, 26, 27, in order to confirm the proper range of the warm working temperature, the properties at warm temperature were measured changing the heating temperature for the steel sheets manufactured using the same steel kind and subjecting heat treatment under the same heat treatment condition. By comparing these data, it is known that, in both of the steel Nos. 26, 27, because working was executed at the temperature deviating from the recommended warm working temperature range, the desired uniform elongation (uEL) at warm temperature cannot be obtained, whereas in the steel No. 25, because working was executed at the temperature within the recommended warm working temperature range, the desired uniform elongation (uEL) at warm temperature can be obtained.

The present invention has been described in detail and referring to a specific embodiment, however, it is clear for a person with an ordinary skill in the art that a variety of alterations and modifications can be added without departing from the spirit and scope of the present invention.

The present application is based on the Japanese Patent Application No. 2011-045163 applied on Mar. 2, 2011, and the contents thereof are hereby incorporated by reference.

INDUSTRIAL APPLICABILITY

The high-strength steel of the present invention is suitable as a thin steel of a frame component for an automobile.

The invention claimed is:

1. A steel sheet comprising, in mass percent:

C: 0.02-0.3%

Si: 1.0-3.0%;

Mn: 1.8-3.0%;
P: 0.1% or less (including 0%);
S: 0.01% or less (including 0%);
Al: 0.001-0.1%; and
N: 0.002-0.03%;
wherein a remainder is iron and impurities,
a microstructure comprises, in terms of area ratio relative to the entire structure, each of the following phases:
bainitic ferrite: 50-85%;
retained austenite: 3% or more;
martensite+the retained austenite: 10-45%; and
ferrite: 5-40%,
a C content ($C_{\gamma R}$) in the retained austenite is 0.6-1.2mass%, and
a ratio $Mn_{\gamma R}/Mn_{av}$ of Mn content $Mn_{\gamma R}$ in the retained austenite and average Mn content $Mn_{av}$ in the entire structure is 1.2 or more based on a Mn content distribution obtained by EPMA line analysis.

2. The steel sheet of claim 1, further comprising:
Cr: 0.01-3.0%;
Mo: 0.01-1.0%;
Cu: 0.01-2.0%;
Ni: 0.01-2.0%; and
B: 0.00001-0.01%.

3. The steel sheet of claim 1 further comprising
Ca: 0.0005-0.01%;
Mg: 0.0005-0.01%; and
REM: 0.0001-0.01%.

4. A method for warm working a steel sheet, comprising heating the steel sheet of claim 1 to 100-400° C.; and working the steel sheet thereafter within 3,600 s.

5. The steel sheet of claim 2, further comprising:
Ca: 0.0005-0.01%;
Mg: 0.0005-0.01%; and
REM: 0.0001-0.01%.

6. The method according to claim 4,
wherein the steel sheet further comprises:
Cr: 0.01-3.0%;
Mo: 0.01-1.0%;
Cu: 0.01-2.0%;
Ni: 0.01-2.0%; and
B: 0.00001-0.01%.

7. The method according to claim 4,
wherein the steel sheet further comprises:
Ca: 0.0005-0.01%;
Mg: 0.0005-0.01%; and
REM: 0.0001-0.01%.

* * * * *